US009982975B1

(12) United States Patent
Huang

(10) Patent No.: US 9,982,975 B1
(45) Date of Patent: May 29, 2018

(54) ARROW SHAFT HAVING A REINFORCED NOCK END

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days. days.

(21) Appl. No.: 15/613,545

(22) Filed: Jun. 5, 2017

(51) Int. Cl.
*F42B 6/06* (2006.01)
*F42B 6/04* (2006.01)

(52) U.S. Cl.
CPC ..... *F42B 6/06* (2013.01); *A63B 2244/04* (2013.01); *F42B 6/04* (2013.01)

(58) Field of Classification Search
None
See application file for complete search history.

(56) References Cited

U.S. PATENT DOCUMENTS

| | | | | |
|---|---|---|---|---|
| 7,115,055 | B2 | 10/2006 | Palomaki et al. | |
| 7,686,714 | B2 * | 3/2010 | Smith | F42B 6/04 473/578 |
| 8,016,703 | B1 * | 9/2011 | Kronengold | F42B 6/08 473/582 |
| 8,579,739 | B2 * | 11/2013 | Song | F42B 6/04 473/578 |
| 2016/0076862 | A1 * | 3/2016 | Connolly | B29C 70/32 473/578 |

* cited by examiner

*Primary Examiner* — John Ricci
(74) *Attorney, Agent, or Firm* — Donald J. Ersler

(57) ABSTRACT

An arrow shaft having a reinforced nock end includes an arrow shaft and a carbon fiber tube retained in a nock end of the arrow shaft. An end of the carbon fiber tube may be flush with the nock end of the arrow shaft or be inserted to a depth to provide clearance for a shaft of an arrow nock. The carbon fiber tube is secured to an inside perimeter of the arrow shaft with any suitable bonding substance. A length of the carbon fiber tube is at least 1.5 inches long, but no longer than 45% of a length of an arrow shaft.

4 Claims, 1 Drawing Sheet

ARROW SHAFT HAVING A REINFORCED NOCK END

BACKGROUND OF THE INVENTION

1. Field of the Invention

The present invention relates generally to archery and more specifically to an arrow shaft having a reinforced nock end, which includes the unexpected result of having a greater travel distance.

2. Discussion of the Prior Art

U.S. Pat. No. 7,115,055 to Palomaki et al. discloses an arrow system with a nock insert. However, it appears that the prior art does not disclose an arrow shaft having a reinforced nock end, which includes a carbon tube insert. The carbon tube insert has a length of at least 1.5 inches, but is not greater in length than 45% of a length of the arrow shaft. It appears that the carbon fiber tube provides harmonic cancellation to oscillation in the arrow shaft during flight. Thus the arrow shaft retains more energy than that of the prior art arrow shafts, which results in the arrow shaft traveling a greater distance than the prior art arrow shafts.

Accordingly, there is a clearly felt need in the art for an arrow shaft having a reinforced nock end, which includes a carbon tube insert and includes the unexpected result of having a greater travel distance.

SUMMARY OF THE INVENTION

The present invention provides an arrow shaft having a reinforced nock end, which includes the unexpected result of having a greater travel distance. The arrow shaft having a reinforced nock end includes an arrow shaft and a carbon fiber tube retained in a nock end of the arrow shaft. An end of the carbon fiber tube may be flush with the nock end of the arrow shaft or be inserted to a depth to provide clearance for a shaft of an arrow nock. The carbon fiber tube is secured to an inside perimeter of the arrow shaft with any suitable bonding substance. A length of the carbon fiber tube is at least 1.5 inches long, but no longer than 45% of a length of an arrow shaft. Accordingly, it is an object of the present invention to provide an arrow shaft having a reinforced nock end, which includes a carbon tube insert and includes the unexpected result of having a greater travel distance.

These and additional objects, advantages, features and benefits of the present invention will become apparent from the following specification.

DETAILED DESCRIPTION OF THE PREFERRED EMBODIMENTS

Figure 1:
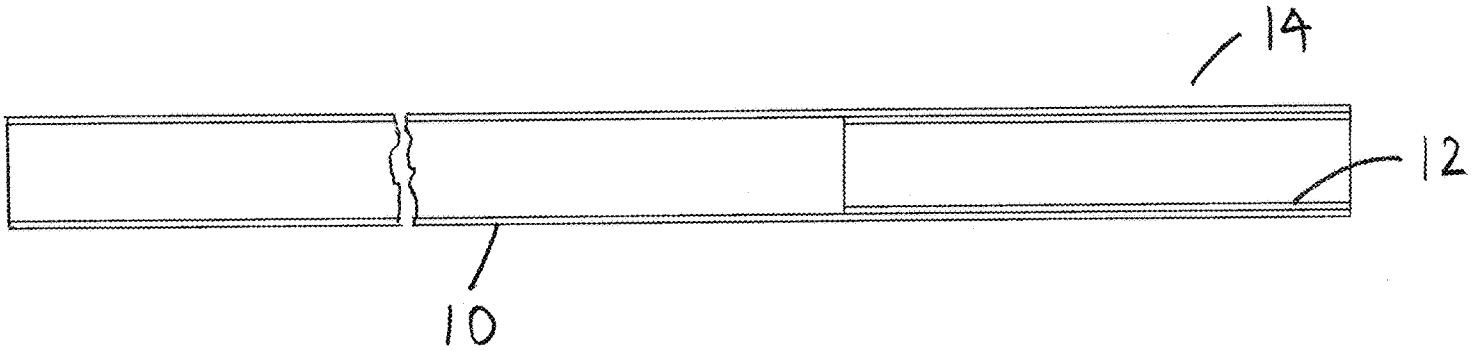
FIG. 1 is a cross sectional view of an arrow shaft having a reinforced end with a flush mounted carbon fiber tube in accordance with the present invention.
Figure 2:
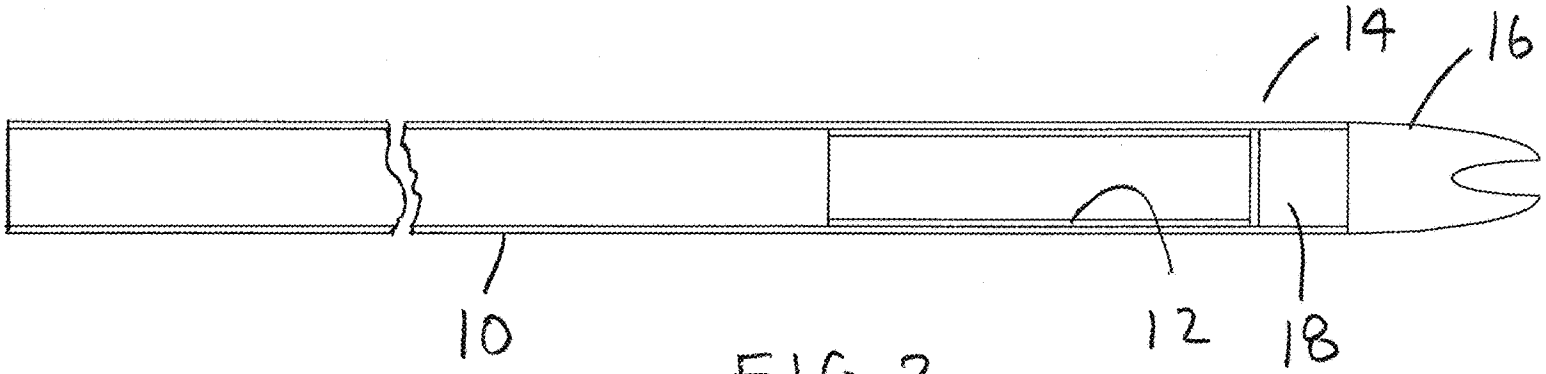
FIG. 2 is a cross sectional view of an arrow shaft having a reinforced end with a carbon fiber tube inserted to a depth of a arrow nock shank in accordance with the present invention.

With reference now to the drawings, and particularly to FIG. 1, there is shown an arrow having a reinforced nock end 1. The arrow having a reinforced nock end 1 preferably includes an arrow shaft 10 and a carbon fiber tube 12 retained in a nock end 14 of the arrow shaft 10. The arrow shaft 10 may fabricated from any suitable material. An end of the carbon fiber tube 12 may be flush with the nock end 14 of the arrow shaft 10 or inserted to a depth to provide clearance for a shaft 18 of an arrow nock 16. The carbon fiber tube 12 is secured to an inside perimeter of the arrow shaft 10 with any suitable bonding substance. A length of the carbon fiber tube 12 is at least 1.5 inches long, but no longer than 45% of a length of an arrow shaft.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An arrow shaft having a reinforced nock end comprising:

an arrow shaft having an inner perimeter and a nock end; and a carbon fiber tube being sized to be inserted into said inner perimeter of said arrow shaft at said nock end, said carbon fiber tube having a length which is at least 1.5 inches, but no longer than 45% of a length of said arrow shaft, said carbon fiber tube is flush with a nock end of said arrow shaft, wherein a nock is placed against said nock end of said arrow shaft, a shank of the nock is inserted into said carbon fiber tube.

2. An arrow shaft having a reinforced nock end of claim 1 wherein:

said carbon fiber tube is bonded to said arrow shaft.

3. An arrow shaft having a reinforced nock end comprising:

an arrow shaft having an inner perimeter and a nock end; and a carbon fiber tube being sized to be inserted into said inner perimeter of said arrow shaft at said nock end, said carbon fiber tube having a length which is at least 1.5 inches, but no longer than 45% of a length of said arrow shaft, an end of said carbon fiber tube is inserted to a depth to provide clearance for a shank of an arrow nock, the shank does not contact said carbon fiber tube, the shank does not extend into said carbon fiber tube.

4. An arrow shaft having a reinforced nock end of claim 3 wherein:

said carbon fiber tube is bonded to said arrow shaft.

* * * * *